US008925331B2

(12) United States Patent
Carrere et al.

(10) Patent No.: US 8,925,331 B2
(45) Date of Patent: Jan. 6, 2015

(54) ANNULAR COMBUSTION CHAMBER OF A TURBOMACHINE

(75) Inventors: Bernard Carrere, Pau (FR); Nicolas Savary, Jurancon (FR)

(73) Assignee: Turbomeca, Bordes (FR)

( * ) Notice: Subject to any disclaimer, the term of this patent is extended or adjusted under 35 U.S.C. 154(b) by 0 days.

(21) Appl. No.: 14/124,511

(22) PCT Filed: Jun. 4, 2012

(86) PCT No.: PCT/FR2012/051240

§ 371 (c)(1),
(2), (4) Date: Jan. 7, 2014

(87) PCT Pub. No.: WO2012/168636

PCT Pub. Date: Dec. 13, 2012

(65) Prior Publication Data

US 2014/0109595 A1 Apr. 24, 2014

(30) Foreign Application Priority Data

Jun. 8, 2011 (FR) ..... 11 54984

(51) Int. Cl.
*F23R 3/60* (2006.01)
*F23R 3/00* (2006.01)

(52) U.S. Cl.
CPC . *F23R 3/60* (2013.01); *F23R 3/002* (2013.01); *F23R 2900/00017* (2013.01)
USPC ..... 60/798; 403/348; 415/214.1

(58) Field of Classification Search
CPC ... F23R 3/60; F23R 3/002; F23R 2900/00017
USPC ..... 60/796, 798, 722, 805, 772; 403/348, 403/349; 415/214.1; 29/889.22
See application file for complete search history.

(56) References Cited

U.S. PATENT DOCUMENTS

| | | | | |
|---|---|---|---|---|
| 4,411,134 | A * | 10/1983 | Moir | 60/796 |
| 5,145,276 | A | 9/1992 | Demange | |
| 5,737,913 | A | 4/1998 | Terry | |
| 7,984,615 | B2 * | 7/2011 | Woodcock et al. | 60/754 |
| 8,104,799 | B2 * | 1/2012 | Huskamp et al. | 285/395 |
| 8,579,538 | B2 * | 11/2013 | Juh et al. | 403/359.5 |
| 2005/0076643 | A1 | 4/2005 | Nguyen et al. | |
| 2007/0031188 | A1 | 2/2007 | Glessner et al. | |

OTHER PUBLICATIONS

International Search Report issued Feb. 13, 2013, PCT/FR12/051240, filed Jun. 4, 2012.

* cited by examiner

*Primary Examiner* — J. Gregory Pickett
(74) *Attorney, Agent, or Firm* — Oblon, Spivak, McClelland, Maier & Neustadt, L.L.P.

(57) ABSTRACT

An annular combustion chamber for a turbomachine presenting an axial direction, a radial direction, and an azimuth direction, the combustion chamber including a first annular wall and a second annular wall, each annular wall defining at least a portion of an enclosure of the combustion chamber. The first annular wall and the second annular wall present complementary assembly mechanisms that co-operate by engagement in azimuth.

9 Claims, 9 Drawing Sheets

ANNULAR COMBUSTION CHAMBER OF A TURBOMACHINE

FIELD OF THE INVENTION

The invention relates to the field of turbomachine combustion chambers, and more particularly to the field of annular combustion chambers for turbomachine and particularly, but not exclusively, for helicopter turboshaft engines.

STATE OF THE PRIOR ART

A conventional annular combustion chamber for a turbomachine presents an axial direction, a radial direction, and an azimuth direction, and it comprises a first annular wall and a second annular wall, each annular wall defining at least a portion of the enclosure of the combustion chamber.

The first and second annular walls may be assembled together by welding, by axial engagement, or by bolting. Assembly by welding makes it impossible to disassemble the first and second walls, e.g. for maintenance or for replacing one of those walls. Assembly by axial engagement presents the drawback of not being leakproof, it being possible for the combustion gas to escape through the overlapping zones of the first and second annular walls. Assembly by bolting presents the drawback of encouraging the appearance of cracks in the vicinity of the holes for receiving the bolts, thereby weakening the combustion chamber.

SUMMARY OF THE INVENTION

An object of the present invention is to remedy the abovementioned drawbacks at least to some extent.

The invention achieves its object by an annular combustion chamber for a turbomachine presenting an axial direction, a radial direction, and an azimuth direction, the combustion chamber comprising a first annular wall and a second annular wall, each annular wall defining at least a portion of the enclosure of the combustion chamber, wherein the first annular wall and the second annular wall present complementary assembly means that co-operate by engagement in azimuth.

It can be understood that the first annular wall has first complementary assembly means and the second annular wall has second complementary assembly means, the first and second complementary assembly means being respectively complementary to each other in such a manner as to be capable of cooperating by mutual engagement. The first complementary means co-operate by engagement in azimuth with the second complementary means. In other words, the first and second complementary assembly means are mutually engaged by making them turn relative to each other about the axial direction of the combustion chamber.

The cooperation between the complementary assembly means by engagement in azimuth makes it possible to reduce the leakage of combustion gas compared with axial engagement. Specifically, since radial thermal expansion is smaller than axial thermal expansion, an assembly formed by engagement in azimuth makes it possible to maintain permanent contact between the first and second annular walls, thus ensuring little or no gas leakage, whatever the conditions of use of the combustion chamber. Furthermore, such engagement in azimuth makes it possible to use clearances that are smaller than with axial engagement, or even to use zero clearance. Furthermore, the mutual engagement of the first and second annular walls makes it possible for them to be disassembled. Thus, compared with prior art assemblies of the first and second annular walls, the assembly by engagement in azimuth of the invention presents the advantage of combining the aspect of being releasable with the aspect of reducing leakage of combustion gas, and even of having leakage that is negligible or zero. Furthermore, such an assembly by engagement in azimuth is simpler to perform than assemblies of the prior art. In particular, the azimuth direction of the engagement makes it possible to achieve alignment and centering around the axial direction more easily than in the state of the art. Also, since the assembly of the invention does not use any bolts, the formation of cracks is avoided. In particular, since the assembly is performed by engagement in azimuth, radial and axial thermal expansions are easily accommodated by the first and second complementary assembly means, which can slide while continuing to be mutually engaged. Thus, such sliding makes it possible firstly to compensate for thermal expansions, while conserving a satisfactory shape for the assembly, and makes it possible secondly to avoid jamming that would encourage the appearance of cracks during thermal expansion.

Advantageously, the first annular wall and the second annular wall present complementary assembly means that co-operate by engagement in azimuth, and the complementary assembly means comprise a plurality of first tongues extending from the first annular wall in azimuth in a first direction, and a plurality of second tongues extending from the second annular wall in azimuth in a second direction, opposite to the first direction, the first and second tongues co-operating by engagement in azimuth.

It can be understood that among the co-operating first and second tongues, each first tongue corresponds to a second tongue with which the first tongue co-operates by engagement. Thus, some number of tongues among the first tongues co-operate with the same number of second tongues. For example, if the complementary assembly means comprise ten first tongues and twelve second tongues, only three first tongues can cooperate by engagement in azimuth with three second tongues. In a variant, the ten first tongues co-operate with ten second tongues. Thus, by engaging with one another, the tongues exert friction forces on one another and/or and elastic bearing forces on one another, so as to hold the first and second annular walls assembled together. It can thus be understood that the first and second tongues deform elastically during engagement in azimuth. The first and second tongues are thus elastic tongues. In particular, this makes it possible to assemble the first and second walls with predetermined clamping torque.

Preferably, the second annular wall has as many second tongues as the first annular wall has first tongues, each first tongue co-operating with a second tongue by engagement in azimuth. This makes it possible to improve the mechanical strength of the assembly and to reduce leaks of combustion gas.

Advantageously, the first annular wall has a first annular flange extending radially, while the second annular wall has a second annular flange extending radially, the first and second flanges co-operating by bearing axially against each other.

It can naturally be understood that the first and second flanges cooperate by bearing against each other when the complementary assembly means are mutually engaged. The bearing cooperation between the first and second flanges enables the first wall to be blocked relative to the second wall in a direction along the axis. Furthermore, the first and second annular flanges advantageously form mutually co-operating sealing surfaces that bear against each other so as to further reduce any leaks of combustion gas.

Advantageously, the first tongues are formed in the first annular flange, while the second tongues are formed in the second annular flange.

Thus, the first and second annular flanges cooperate by bearing against each other in a first direction along the axis, while the first and second tongues, when they are engaged in azimuth, co-operate by bearing against each other along the axis in a second direction, opposite to the first direction. The complementary shapes of the flanges and the tongues makes it possible firstly to ensure that assembly is reliable and mechanically strong, and secondly to reduce any leaks of combustion gas. Also, by being arranged on the annular flanges, the tongues compensate for any differential thermal expansion, in particular radial expansion, by sliding relative to one another. Thus, the assembly is relatively insensitive to thermal expansion and the engagement remains reliable whatever the thermal conditions under which the combustion chamber is used. In an embodiment, the first and second tongues are machined by laser cutting (the first and second annular walls being made of metal). This makes it possible to form the tongues during the machining of the first or second annular wall in a single operation. This serves to improve the accuracy of cutting, and thus the quality of the assembly (increased mechanical strength, decreased leakage).

Advantageously, the first tongues form a pre-formed angle in the first direction along the axis relative to the first flange, while the second tongues form a pre-formed angle relative to the second flange in the second direction along the axis and opposite to the first direction.

The tongues as preformed in this way, i.e. forming a predetermined angle with the flange in which they have been formed and before being engaged, are easier to engage with one another. Preferably, each of the first and second tongues forms a preformed angle lying in the range 1° to 5° (degrees of angle) respectively with the first flange and with the second flange. More preferably, each of the first and second tongues forms a preformed angle of about 2° (degrees of angle) respectively with the first flange and with the second flange. The term "about" means an angle value plus or minus half a degree of angle (i.e. in this example 2°±0.5°). This value of 2° makes it possible to form elastic tongues in the axial direction that present satisfactorily stiffness for ensuring a predetermined clamping torque for engagement in azimuth, together with a configuration that is compact.

Advantageously, the combustion chamber has blocking means for blocking the rotation of second annular wall relative to the first annular wall (or vice versa).

The blocking means serve to block relative movements of the first and second annular walls in the azimuth direction. Thus, when the complementary assembly means are engaged in azimuth, the blocking means lock the engagement and prevent the complementary assembly means from coming apart. This makes it possible to ensure greater reliability for the interconnection of the first and second annular walls.

Advantageously, the first annular wall has at least one first blocking means, while the second annular wall presents at least one second blocking means, at least one first blocking means co-operating with at least one second blocking means to block the first annular wall against turning relative to the second annular wall.

Advantageously, the first wall has a plurality of first blocking means, while the second wall has a plurality of second blocking means, the first or the second blocking means being distributed uniformly in azimuth while the other blocking means from among the first and second blocking means are not uniformly distributed in azimuth.

In a first a variant, the blocking means comprise at least one screw for securing the first annular wall to the second annular wall.

Advantageously, the screw passes through the first and second annular flanges and holds them together.

It can be understood that the securing screw is either screwed directly into the thickness of the walls (i.e. co-operates directly with the first and second annular flanges by screwing into them), or else is held in place with the help of a nut, the nut-and-bolt fastener clamping together the first and second annular flanges. It should be observed that such a screw does not generate cracking in the vicinity of its engagement holes through the flanges since it does not block thermal expansion and it does not generate local stresses capable of leading to cracking.

In this first variant, the first wall (or the first flange) may have only one first hole for passing the screw, or else a plurality of them, the first hole(s) forming one or more first blocking means, while the second wall (or the second flange) may have only one second hole for passing the screw, or else a plurality of them, the second hole(s) forming one or more second blocking means. First blocking means (or a first hole) co-operate by screw-coupling, with second blocking means (or a second hole) to block the first annular wall against turning relative to the second annular wall.

In a second variant, the blocking means comprise at least a first projection secured to the first annular wall and at least a second projection secured to the second annular wall, the complementary assembly means co-operating in azimuth by engagement in a first direction, and wherein the first projection and the second projection cooperate in azimuth by elastic engagement in the first direction, while they cooperate in azimuth in abutment in a second direction that is opposite to the first direction.

When the complementary assembly means are engaged in azimuth, the first projection engages with the second projection. During the engagement movement, one or both of the projections become(s) elastically deformed in such a manner as to allow one of the projections to pass beyond the other projection. Once engagement is completed, e.g. by positioning the second annular wall in azimuth at a predetermined position relative to the first annular wall, the first projection and the second projection disengage from each other and return to their initial shapes. Thus, the engagement of the first and second annular walls is blocked in azimuth both in a first direction by the complementary assembly means, which are at the end of their stroke or blocked (e.g. it would be necessary to deliver a clamping torque greater than the forces generated by vibration or by the differential thermal expansion within the combustion chamber in order to unblock them in this first direction), and also in a second direction opposite to the first by the two projections that are co-operating in abutment. It can be understood that when the blocking means comprise a plurality of first projections and a plurality of second projections, at least one first projection co-operates with at least one second projection, it also being possible for one or more other first projection(s) to co-operate respectively with one or more other second projections.

Advantageously, the first projection extends substantially radially from the first flange, while the second projection extends substantially radially from the second flange.

In this second variant, the or each first projection forms the first blocking means, while the or each second projection forms the second blocking means.

In a third variant, the blocking means comprise at least one foldable blade formed in one of the flanges selected from the first and second annular flanges that is engaged in a gap formed in the other one of the flanges selected from the first and second annular flanges.

It can be understood that the first or second flange presents a foldable blade, while the other flange from among the first and second flanges presents a gap (i.e. a window or a cutout) into which the foldable blade is engaged by being folded when the complementary assembly means are engaged in azimuth. For example, the gap is open beside the free edge of the flange and it forms a U-shape. Thus, in order to engage the blade in the gap, it suffices to fold down the blade by folding it into the bottom of the U-shape of the gap. The vertical edges of the U-shape limit and/or block relative movements in the azimuth direction between the first and second annular walls by cooperating in abutment with the edges of the folded blade.

In this third variant, the or each foldable blade form(s) the first coupling means, while the or each gap form(s) the second coupling means (or vice versa).

The invention also provides a turbomachine including a combustion chamber of the invention.

The invention also provides an assembly method for assembling an annular combustion chamber of the invention the method comprising the steps of:

presenting complementary assembly means of the facing first and second annular walls; and engaging the complementary assembly means in azimuth by turning the second annular wall relative to the first annular wall.

It can naturally be understood that the turning for the engagement in azimuth is performed about the axial direction.

Advantageously, the annular combustion chamber includes blocking means for blocking the rotation of the second annular wall relative to the first annular wall, and said method further comprises the step of blocking the second annular wall against turning (in the azimuth direction) relative to the first annular wall.

BRIEF DESCRIPTION OF THE DRAWINGS

The invention and its advantages can be better understood on reading the following detailed description of various embodiments of the invention given as nonlimiting examples. The description makes reference to the accompanying figures, in which.

DETAILED DESCRIPTION OF EMBODIMENTS

Figure 1:
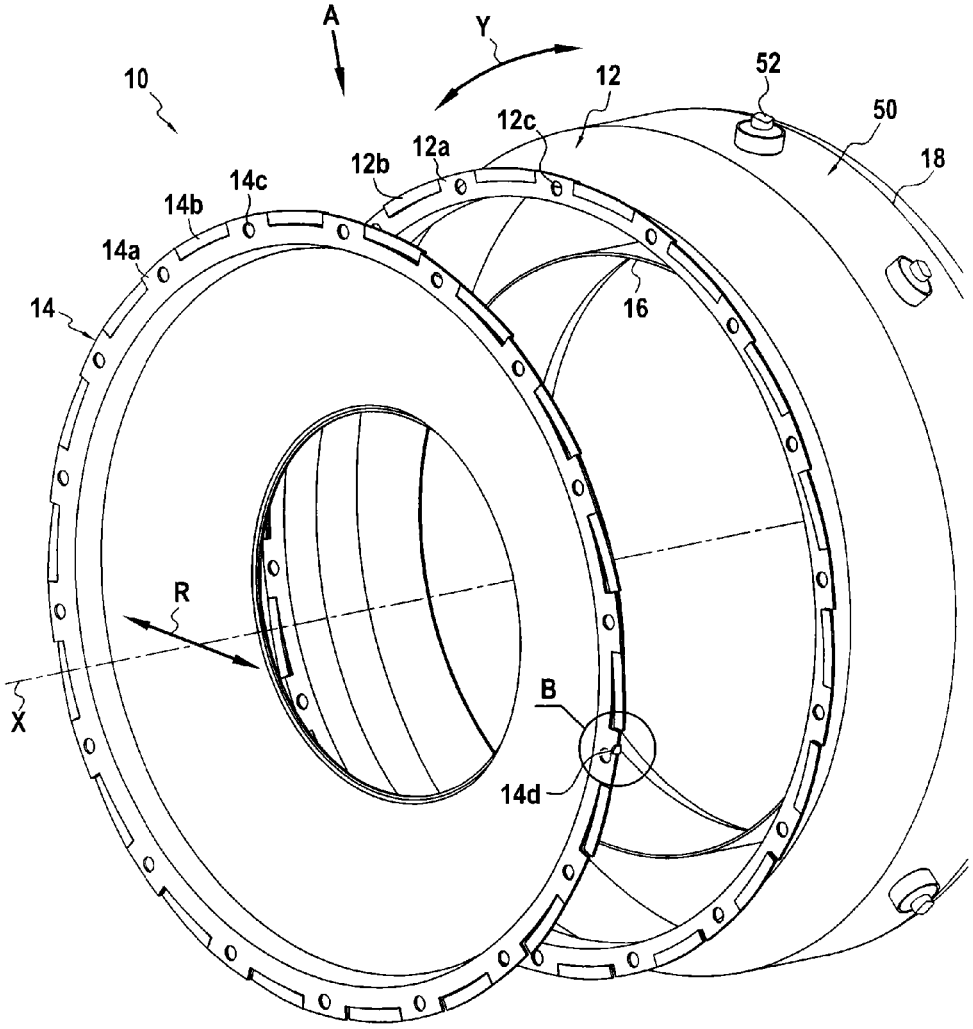
FIG. 1 shows a first embodiment of the invention in an exploded view in perspective.

FIGS. 1, 1A, 1B, 2, 3, 4A, and 4B show a first embodiment of the combustion chamber of the invention corresponding to the first above-mentioned variant. The combustion chamber 10 has a first annular wall 12 and a second annular wall 14. The combustion chamber 10 presents an axial direction X (along the axis X), a radial direction R, and an azimuth direction Y. The combustion chamber 10 presents symmetry of revolution about the axis X. In this example, the first wall 12 is the outer casing of the flame tube 50, which tube also has an inner casing 16 and a chamber end wall 18. The flame tube 50 receives fuel injectors 52 and it defines the enclosure in which the fuel is burned, i.e. where combustion takes place. The second wall 14 forms an outer bend and serves as a deflector for guiding the flow of gas coming from the flame tube 50. It should be observed that this combustion chamber 10 is an annular chamber of the reverse flow type, however the invention is not limited to this particular type of combustion chamber. Likewise, the first and second annular walls could be walls other than the outer casing wall and the outer bend wall.

Figure 1A:
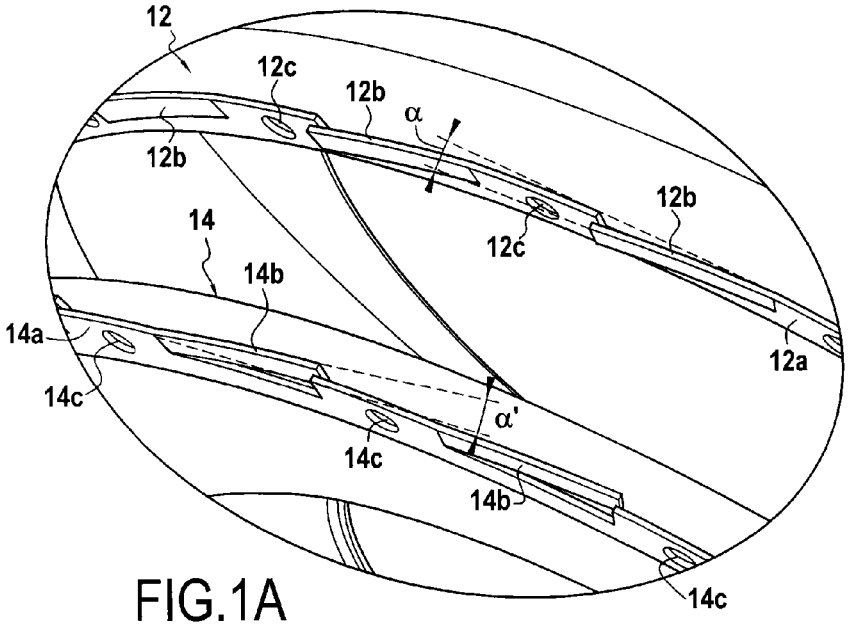
FIG. 1A shows a view of the first embodiment seen looking along an arrow A of FIG. 1.

The first annular wall 12 presents a first annular flange 12*a* that extends radially outwards from the combustion chamber 10, while the second annular wall 14 likewise presents a second annular flange 14*a* that extends radially outwards from the combustion chamber 10. The first flange 12*a* presents N first tongues 12*b* oriented in a first azimuth direction, while the second flange presents N second tongues 14*b* oriented in a second azimuth direction opposite to the first azimuth direction. In this example, there are eighteen first and second tongues, i.e. N=18. The orientation of a tongue is defined by the direction in which extends from its proximal end towards its distal or free end. As shown in FIG. 1A, when the first and second annular walls 12 and 14 are facing each other in order to be assembled together, the first tongues 12*b* form a preformed angle $\alpha$, in this example $\alpha=2°$, in the axial direction towards the second flange 14*a*, while the second tongues 14*b* form a preformed angle $\alpha'$, in this example $\alpha'=2°$, in the axial direction towards the first flange 12*a*. The first and second tongues 12*b* and 14*b* are of similar azimuth length and they are all uniformly distributed angularly respectively on the first and second flanges 12*a* and 14*a*. In other words, the angular space between two adjacent tongues is identical for all of the tongues.

The radial extents of each flange and of each tongue are identical. The tongues extend radially over only a radial portion of each flange (i.e. they do not extend over the entire radial width of the flanges) in order to provide the assembly of the first and second walls 12 and 14 with good sealing against the combustion gas. In the example of FIG. 1, each of the first and second flanges 12*a* and 14*a* presents a radially inner portion and a radially outer portion in which the tongues are formed. In this example, the radially inner portion extends radially over 4 mm (four millimeters).

Figure 3:
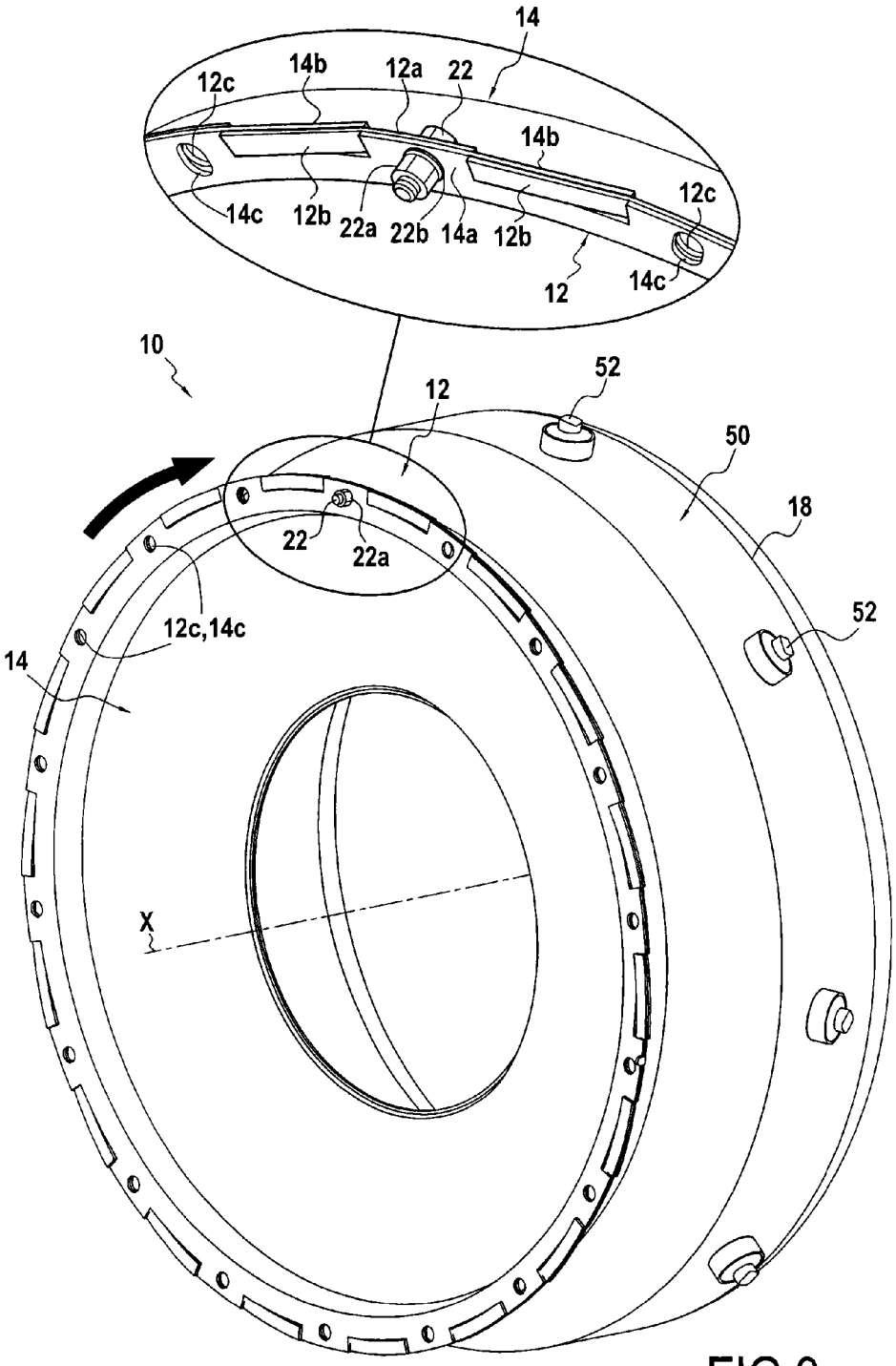
FIG. 3 shows the first embodiment of FIG. 1 when assembled.

Each of the first and second annular flanges 12*a* and 14*a* respectively presents M first through holes 12*c* and M second through holes 14*c* in order to engage a screw 22 therein (cf. FIG. 3). When assembled together, the first and second holes 12*c* and 14*c* together with the screw 22 form blocking means for blocking rotation. In this example, there are eighteen first and second holes, i.e. M=18.

Figure 2:
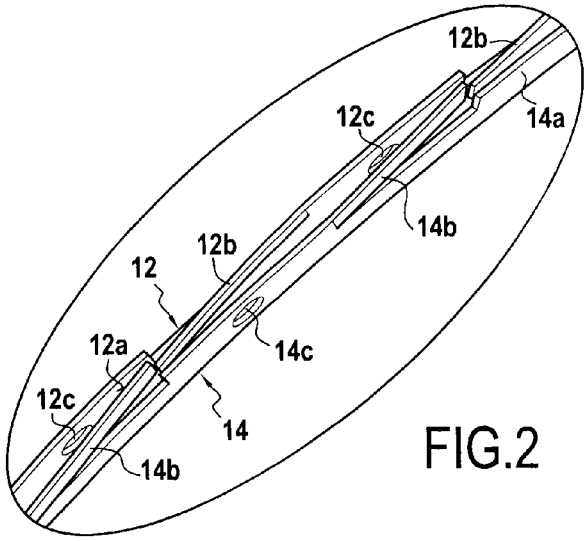
FIG. 2 shows an intermediate step during assembly of the first and second annular walls of the first embodiment by azimuth engagement.

In order to assemble the first and second annular walls 12 and 14 together, the second annular wall 14 is presented facing the first annular wall 12, as shown in FIG. 1, these two walls 12 and 14 are moved axially towards each other in such a manner that the distal ends of the first tongues 12*b* are arranged axially between the distal ends of the second tongues 14*b* and the second flange 14*a* (or vice versa, cf. FIG. 2). In other words, the complementary means of the assembly are made to face each other and the first and second tongues 12*b* and 14*b* are engaged in azimuth by causing the second annular wall 14 to pivot about the axis X of the combustion chamber 10 in the direction of the bold arrow in FIG. 3. During engagement, the axial inclination of the first and second tongues (or the angle formed by each tongue) and their stiffness causes the first and second flanges 12*a* and 14*a* to bear against each other, as shown in FIG. 3.

Figure 1B:
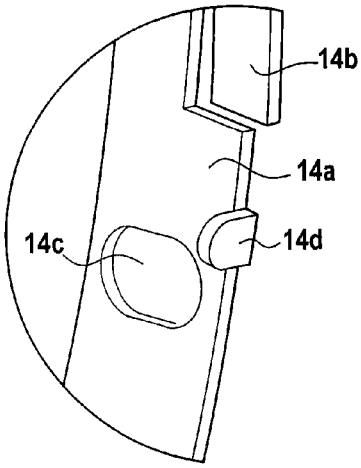
FIG. 1B shows a detail B of the first embodiment of FIG. 1.

In order to make it easier to turn the second wall 14 about the axial direction X during azimuth engagement of the first tongues 12*b* with the second tongues 14*b*, a handling lug 14*d* projects from the periphery of the second flange 14*a* (cf. FIGS. 1 and 1B).

Figure 4A:
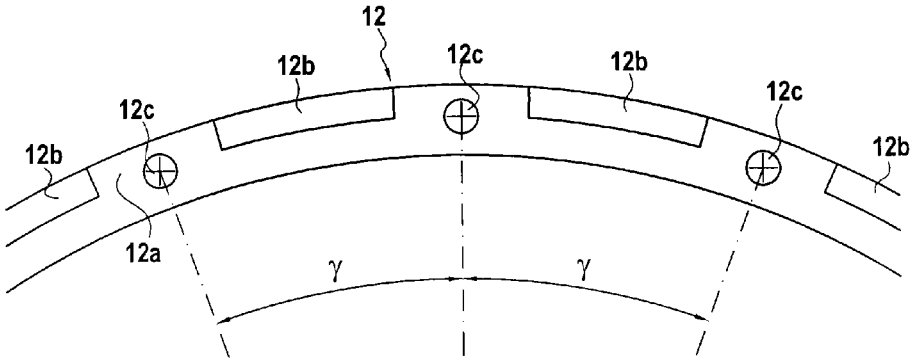
FIGS. 4A and 4B show the angular spacing of the holes in the first embodiment for mounting the screw for blocking the first annular wall against turning relative to the second annular wall.
Figure 4B:
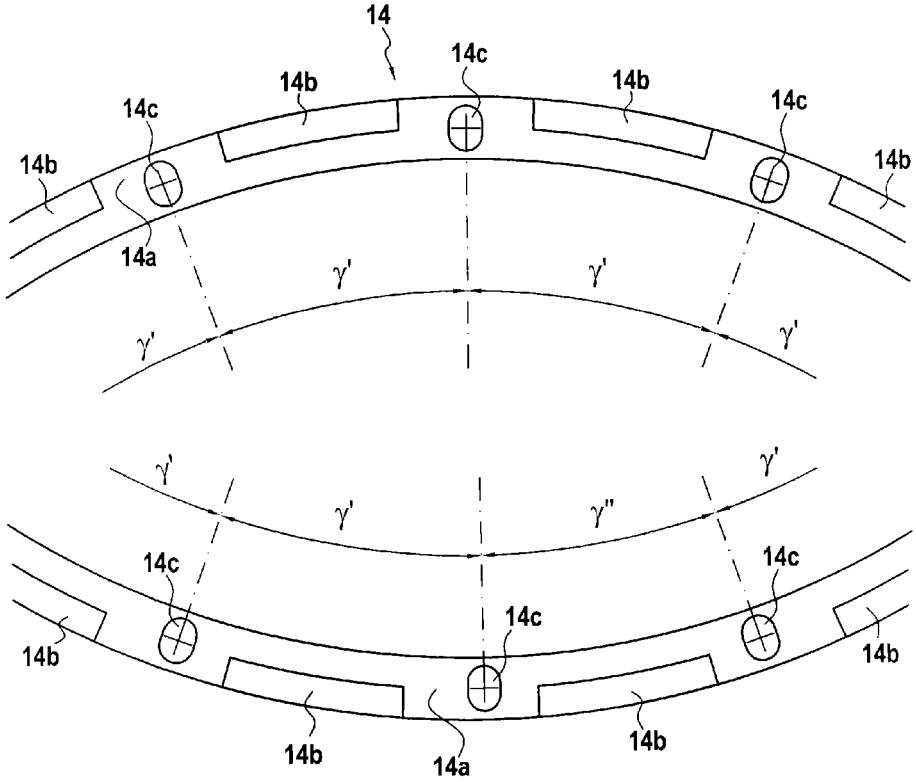

When the first and second annular walls 12 and 14 are engaged in azimuth, they are prevented from turning relative to each other about the axis X by engaging a screw 22 in two facing holes 12*c* and 14*c*. In this example, the screw 22 is held by a nut 22*a* and a lock washer 22*b*. As shown in FIGS. 1B and 4B, the holes 14*c* are oblong in shape and radial in orientation so as to make it easier to insert the screw 22 through the two holes 12*c* and 14*c*. In particular, this oblong shape makes it possible to compensate for any lack of coincidence between the axes of the first and second annular walls 12 and 14, or for any defect in machining the holes.

In order to ensure that at least a first hole 12*c* is in alignment in azimuth with a second hole 14*c* when the first and second annular walls 12 and 14 are assembled together, with this applying regardless of the clamping torque or the final position of the engagement, the first and second holes are distributed in azimuth as follows. The first holes 12*c* are uniformly distributed in azimuth (cf. FIG. 4A). Each first hole is spaced apart from the two adjacent first holes by an angle $\gamma=360°/M$. In this example, since there are eighteen first holes (M=18), the spacing is $\gamma=20°$. The majority of the second holes 14*c* are spaced apart in azimuth by an angle $\gamma'$ that is greater than the angle $\gamma$ by a difference $\Delta\gamma$, i.e. $\gamma'=\gamma+\Delta\gamma$. Nevertheless, not all of these second holes 14*c* are regularly spaced in azimuth. Specifically, this majority spacing of $\gamma'$ gives rise to an offset in the azimuth distribution of the second holes in such a manner that two adjacent second holes are spaced apart by an angle $\gamma''$ that is less than $\gamma$ and $\gamma'$, where $\gamma''$ is calculated using the following relationship: $\gamma''=\gamma-(M-1)\Delta\gamma$, M being the number of second holes. In this example, $\Delta\gamma=0.1°$, M=18, and $\gamma=20°$, such that $\gamma'=20.1°$ and $\gamma''=18.3°$ (cf. FIG. 4B). Naturally, in a variant, the distribution of the first and second holes in azimuth could be inverted. The first holes form the first blocking means, while the second holes form the second blocking means, and they may naturally be provided in different numbers.

FIGS. 5, 5A, 5B, 5C, and 5D show a second embodiment of the combustion chamber of the invention corresponding to the above-described second variant. Only the blocking means differ from the first embodiment, so portions that are common to the first and second embodiments are not described again and they keep the same reference signs. In particular, the first and second tongues 12*b* and 14*b* are engaged in azimuth in the same manner as in the first embodiment.

The blocking means of the combustion chamber 110 in the second embodiment of the invention correspond firstly to a number P of first projections 112 secured to the first wall 12, and secondly to the same number P of second projections 114 secured to the second wall 14. In this example, there are eighteen first and second projections, i.e. P=18. More particularly, the first projections 112 extend radially from the first annular flange 12*a*, while the second projections 114 extend radially from the second annular flange 14*a*. Each first and second projection 112 and 114 forms a hook having an L-shaped profile, the top of the vertical bar of the L-shape being connected to the corresponding annular flange, while the horizontal bar of the L-shape extends axially. The plate 112*a* and 114*a* formed by the horizontal bar of the L-shaped hook of each projection 112 and 114 is inclined at a respective angle $\beta$ and $\beta'$ relative to the azimuth direction (cf. FIG. 4A), the plates 112*a* and 114*a* of the first and second projections 112 and 114 being inclined in the same direction. Thus, it is possible to engage on the second projections 114 "under" the first projections 112 in a first azimuth direction, with the plates 112*a* and 114*a* co-operating by bearing against each other. In this example, each of the projections 112*a* and 114*a* has the same angle of inclination, i.e. $\beta=\beta'$. Furthermore, in this example, the angle of inclination of the projections 112*a* and 114*a* is four degrees, i.e. $\beta=\beta'=4°$.

Figure 5:
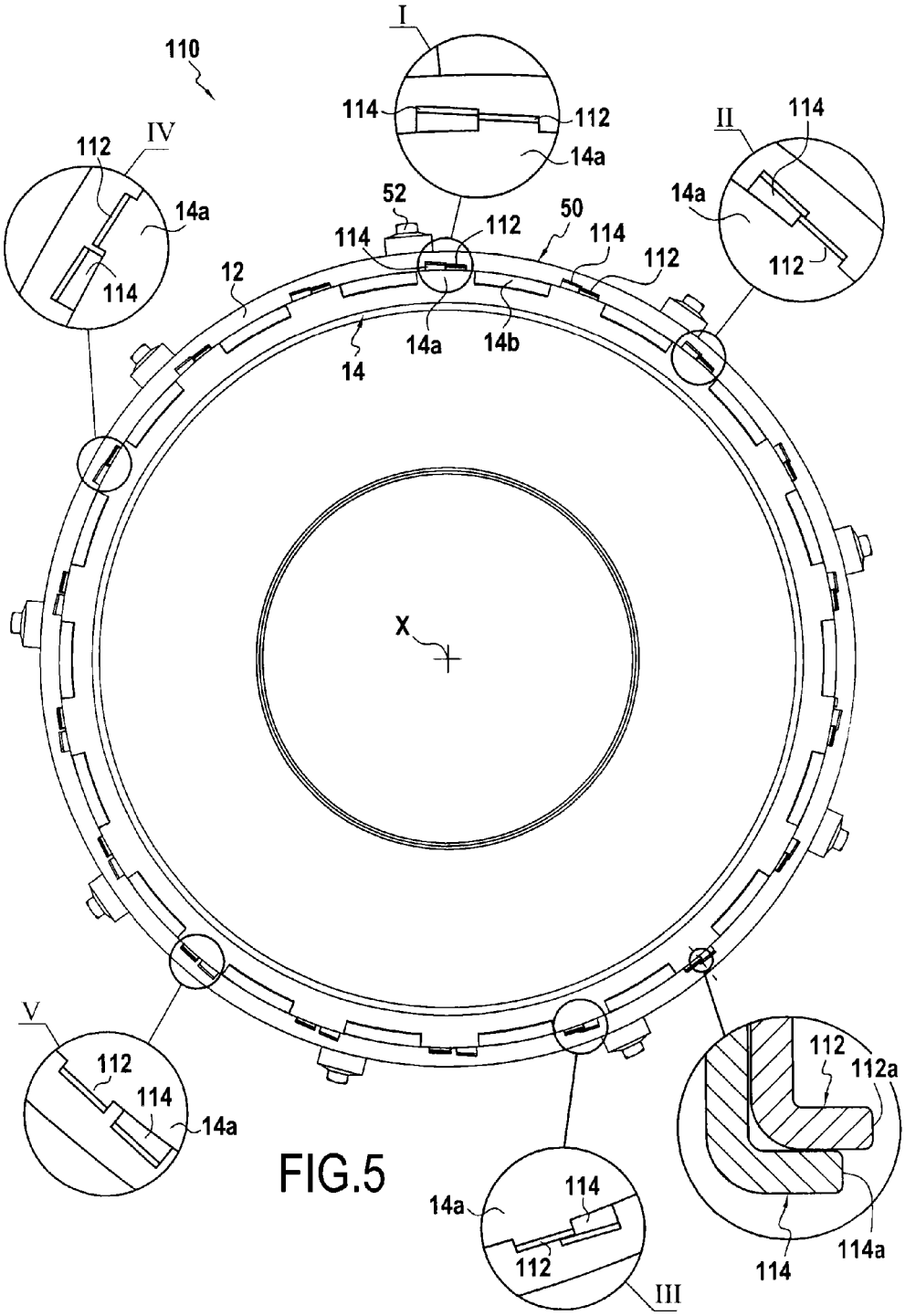
FIG. 5 shows a second embodiment of the invention seen looking in the axial direction.
Figure 5A:
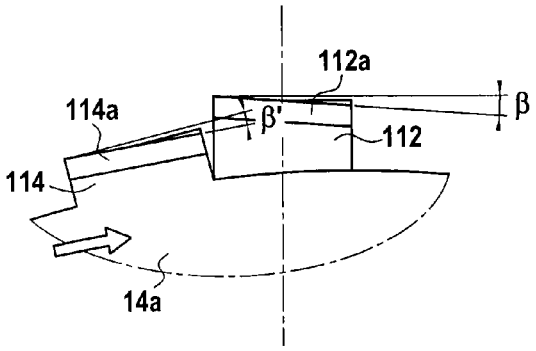
FIGS. 5A, 5B, 5C, and 5D show four successive relative positions of the projections during engagement in azimuth of the complementary assembly means.
Figure 5B:
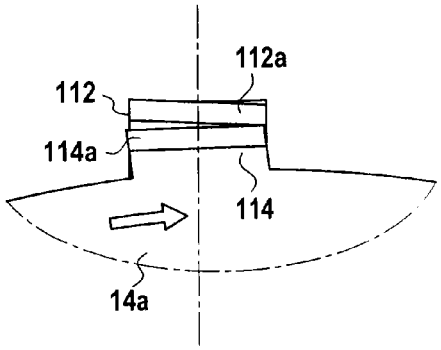
Figure 5C:
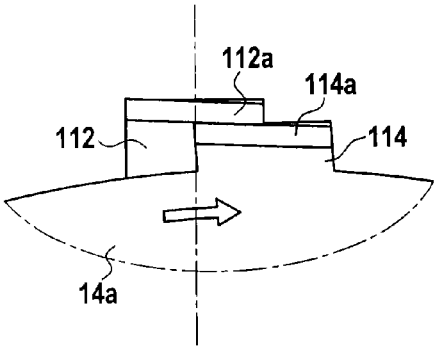
Figure 5D:
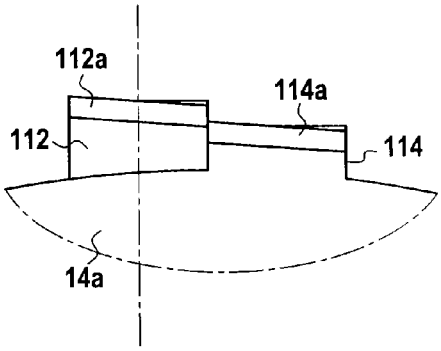

FIGS. 5A to 5D show four relative positions of a first projection 112 relative to a second projection 114 while the first and second tongues are being engaged in azimuth. When the first and second tongues 12*b* 14*b* are not engaged (position shown in FIG. 2), or at the beginning of azimuth engagement, the first and second projections 112 and 114 do not cooperate as shown in FIG. 5A. As azimuth engagement of the first and second tongues 12*b* and 14*b* progresses, the first and second projections engage each other by passing successively from the position of FIG. 5A to the position of FIG. 5B, and from the position of FIG. 5B to the position of FIG. 5C, with the second annular wall 12 being moved by turning in the direction of the arrow shown in FIGS. 5A, 5B, and 5C. During this movement, the plates 112*a* and 114*a* cooperate by bearing radially against each other, and they deform elastically so as to allow the second projection 114 to pass from a position to the left of the first projection 112 (cf. FIG. 5A) to a position to the right of the first projection 112 (cf. FIG. 5D). Once the engagement of the first and second tongues 12*b* and 14*b* is sufficiently advanced, the second projection 114 disengages from the first projection 112, with each plate 112*a* and 114*a* returning to its initial, non elastically-deformed position (cf. FIG. 5D). As from this moment, because of the azimuth inclination of the plates 112*a* and 114*a*, a radial shoulder is formed between the projections 112 and 114, blocking any azimuth disengagement movements of the first and second tongues 12*b* and 14*b* (in the direction opposite to the arrow in FIGS. 5B and 5C). The first projection 112 and the second projection 114 co-operate by resilient engagement in a first azimuth direction in FIGS. 5B and 5C (in the direction of the arrow), whereas, in a second azimuth direction opposite to the first azimuth direction, they co-operate in abutment, FIG. 5D.

In order to ensure that, for a predetermined clamping torque or engagement position of the first and second walls 12 and 14, at least one first projection 112 co-operates in abutment in the second direction with a second projection 114, the first and second projections are distributed in azimuth in the same manner as the first and second holes in the first embodiment. Thus, the first projections 112 are uniformly distributed in azimuth, while the second projections 114 are not uniformly distributed in azimuth. Consequently, the first projections are all spaced apart by an angle $\gamma=360°/P$, while the second projections are spaced apart by an angle $\gamma'$ greater than the angle $\gamma$ by a difference $\Delta\gamma$, i.e. $\gamma'=\gamma+\Delta\gamma$, except for two adjacent second projections that are spaced apart by an angle $\gamma''=\gamma-(P-1)\Delta\gamma$. Thus, in this example, with P=18 and $\Delta\gamma=0.1°$, we have $\gamma=20°$, $\gamma'=20.1°$ and $\gamma''=18.3°$. Naturally, in a variant, the distribution of the first and second projections in azimuth could be inverted. It can be understood that the first projections form the first blocking means while the second projections form the second blocking means, and they may naturally be provided in different numbers.

FIG. 5 shows a clamping configuration in which the first and second projections co-operate in abutment and in elastic engagement (cf. I), whereas in P/2−1 pairs of first and second projections the elastic engagement is not completed (to the right in azimuth of the pair I of projections, cf. II and III), and whereas the first and second projections in the P/2 other pairs of first and second projections are engaged elastically in part but are spaced apart in azimuth in such a manner that they do not cooperate in abutment (to the left in azimuth of the pair I of projections, cf. IV and V).

Figure 6:
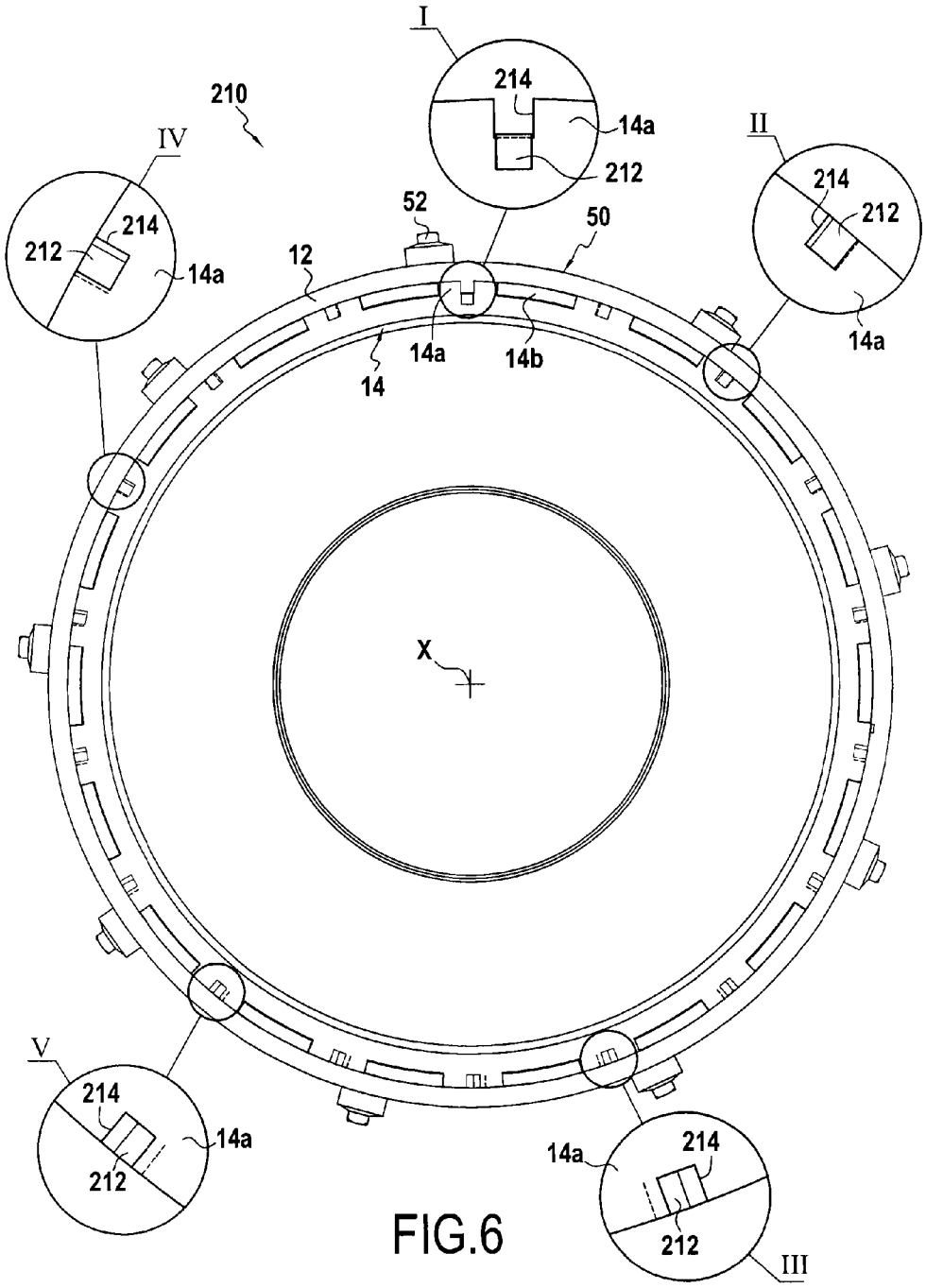
FIG. 6 shows a third embodiment of the invention seen looking in the axial direction.
Figure 6A:
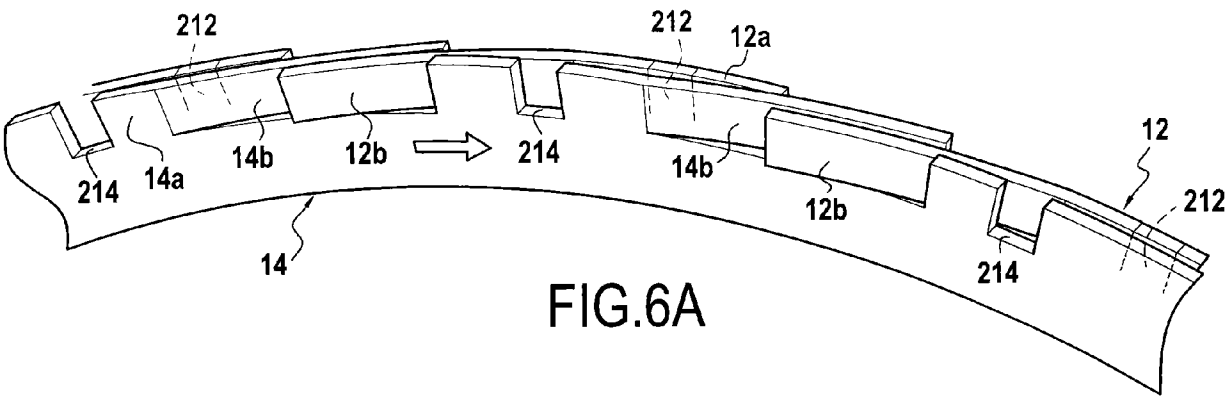
FIGS. 6A and 6B show two successive relative positions of the blade and of the gap during engagement in azimuth of the complementary assembly means.
Figure 6B:
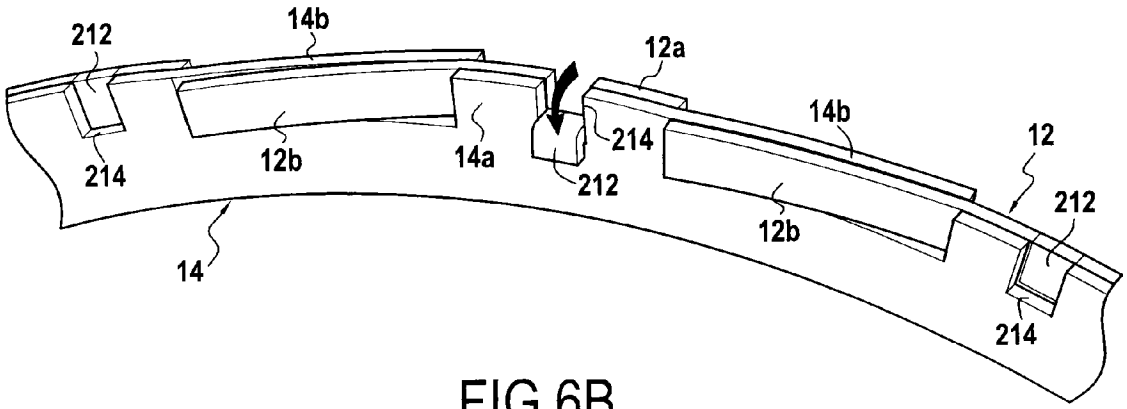

FIGS. 6, 6A, and 6B show a third embodiment of the combustion chamber of the invention corresponding to the above-described second variant. Only the blocking means differ from the first and second embodiments, so portions that are common to the second and third embodiments are not described again and they keep the same reference signs. In particular, the first and second tongues 12*b* and 14*b* are engaged in azimuth in the same manner as in the first and second embodiments.

The blocking means of the combustion chamber 210 in the third embodiment of the invention comprise firstly a number Q of foldable blades 212 formed in the first flange 12*a*, and secondly the same number Q of gaps 214 formed in the second flange 14*a*. In this example, there are eighteen blades and gaps, i.e. Q=18. The gaps 214 are U-shaped, opening out to the outer periphery of the flange 14*a*. Naturally, in a variant, the gaps could be provided in the first flange, while the foldable blades could be formed in the second flange. The foldable blades form the first blocking means, while the gaps form the second blocking means, and they may naturally be provided in different numbers.

FIGS. 6A and 6B show two relative positions of foldable blades 212 relative to gaps 214 while the first and second tongues are being engaged in azimuth. When the second wall 14 is caused to pivot about the axis X in order to engage the first and second tongues 12*b* and 14*b* in the direction of the arrow in FIG. 6A, the gaps 214 tend to be brought into register with the blades 212. In the same manner as above, the foldable blades 212 are uniformly distributed in azimuth, and they are all spaced apart in azimuth by an angle $\gamma=360°/Q$. The gaps are not uniformly distributed in azimuth, and they are spaced apart at an angle $\gamma'$ greater than the angle $\gamma$ by a difference $\Delta\gamma$, i.e. $\gamma'=\gamma+\Delta\gamma$, except for two adjacent gaps, which are spaced apart by $\gamma''=\gamma-(Q-1)\Delta\gamma$. Thus, in this example, with Q=18 and $\Delta\gamma=0.1°$, we have $\gamma=20°$, $\gamma'=20.1°$ and $\gamma''=18.3°$. Naturally, this angular spacing could be inverted. Thus, it is ensured that for a predetermined clamping torque or engagement position of the first and second walls 12 and 14, there is a gap 214 in register with a foldable blade 212 in such a manner as to make it possible to engage the blade 212 in the gap 214 by folding it (cf. FIG. 6B).

FIG. 6 shows a clamping configuration in which a foldable blade 212 is engaged in a gap 214 (cf. I) while Q/2−1 blades 212 are offset to the left in azimuth from Q/2−1 facing gaps 214 (to the right in azimuth from the pair I of projections, cf. II and III) and while Q/2 blades 212 are offset to the right in azimuth (in FIG. 6) from Q/2 facing gaps (on the left in azimuth from the pair I of projections, cf. IV and V) such that they cannot be engaged in the facing gaps. Thus, with a blade 212 engaged in a gap 214, the blade 212 and the gap 214 co-operate in azimuth in both directions in abutment and they block relative turning about the axis X between the first and second walls 12 and 14.

In general manner, when the combustion chamber presents the same number K of first and second blocking means, the spacing angle in azimuth of the adjacent first blocking means is $\gamma=360°/K$, while the spacing angle in azimuth of the adjacent second blocking means is $\gamma'$, which is greater than the angle $\gamma$ by a difference $\Delta\gamma$, i.e. $\gamma'=\gamma+\Delta\gamma$, except for two adjacent second means, which are spaced apart by $\gamma''=\gamma-(K-1)\Delta\gamma$. In a variant, the angular distribution of the first and second blocking means could be inverted.

Figure 7:
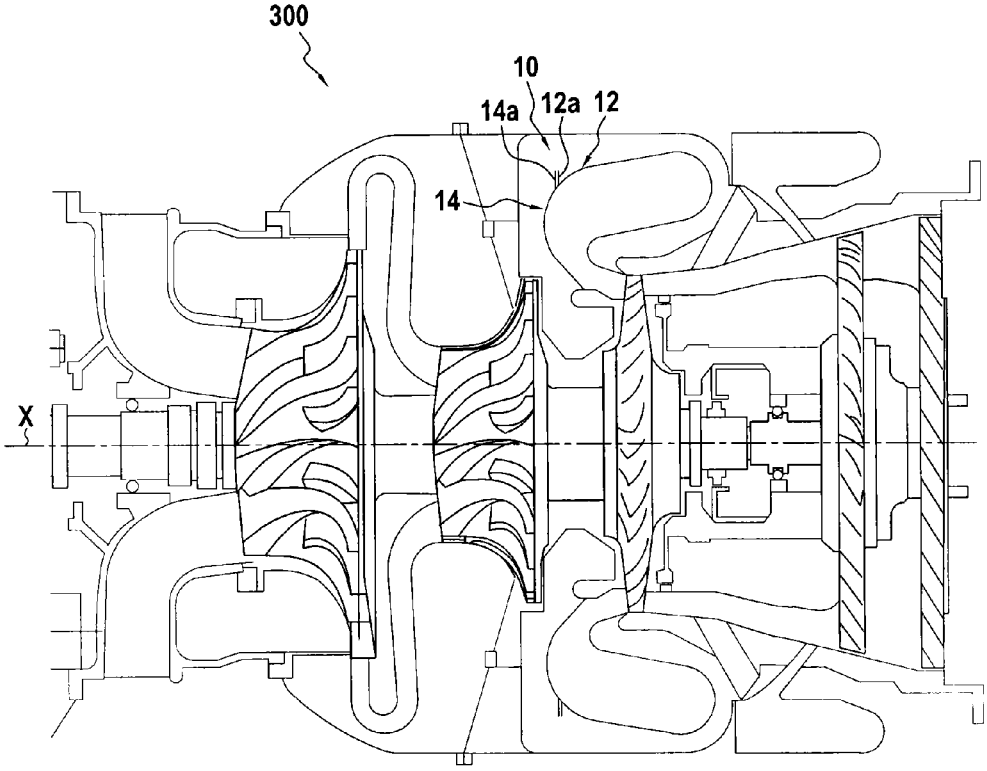
FIG. 7 shows a turbomachine fitted with the FIG. 1 combustion chamber.

FIG. 7 shows a helicopter turboshaft engine 300 having an annular combustion chamber 10. Naturally, in a variant, the engine 300 is fitted with a combustion chamber 110 or 210.

The invention claimed is:

1. An annular combustion chamber for a turbomachine presenting an axial direction, a radial direction, and an azimuth direction, the combustion chamber comprising:

a first annular wall and a second annular wall, each annular wall defining at least a portion of an enclosure of the combustion chamber, wherein the first annular wall and the second annular wall present complementary assembly means that co-operate by engagement in azimuth, and wherein the complementary assembly means comprises a plurality of first tongues extending from the first annular wall in azimuth in a first direction, and a plurality of second tongues extending from the second annular wall in azimuth in a second direction, opposite to the first direction, the first and second tongues co-operating by engagement in azimuth.

2. An annular combustion chamber according to claim 1, wherein the first annular wall includes a first annular flange extending radially, and the second annular wall includes a second annular flange extending radially, the first and second flanges co-operating by bearing axially against each other.

3. An annular combustion chamber according to claim 2, wherein the first tongues are formed in the first annular flange, and the second tongues are formed in the second annular flange.

4. An annular combustion chamber according to claim 1, further comprising blocking means for blocking rotation of the second annular wall relative to the first annular wall.

5. An annular combustion chamber according to claim 4, wherein the blocking means comprises at least a first projection secured to the first annular wall and at least a second projection secured to the second annular wall, the complementary assembly means co-operating in azimuth by engagement in a first direction, and wherein the first projection and the second projection cooperate in azimuth by elastic engagement in the first direction, and cooperate in azimuth in abutment in a second direction that is opposite to the first direction.

6. An annular combustion chamber according to claim 4, wherein the first annular wall includes a first annular flange extending radially, and the second annular wall includes a second annular flange extending radially, the first and second flanges co-operating by bearing axially against each other, and wherein the blocking means comprises at least one foldable blade formed in one of the flanges selected from the first and second annular flanges that is engaged in a gap formed in the other one of the flanges selected from the first and second annular flanges.

7. A turbomachine comprising an annular combustion chamber according to claim 1.

8. An assembly method for assembling an annular combustion chamber according to claim 1, comprising:

presenting complementary assembly means of the facing first and second annular walls; and engaging the complementary assembly means in azimuth by turning the second annular wall relative to the first annular wall.

9. An assembly method according to claim 8, for assembling an annular combustion chamber including blocking means for blocking rotation of the second annular wall relative to the first annular wall, the method further comprising blocking the second annular wall against turning relative to the first annular wall.

* * * * *